United States Patent [19]

Dembowski et al.

[11] Patent Number: 4,517,493

[45] Date of Patent: May 14, 1985

[54] FLUORESCENT LAMP WITH CATHODE HEAT SWITCHES

[75] Inventors: Peter V. Dembowski, Richmond Heights; Quentin D. Dobras, Chesterland, both of Ohio

[73] Assignee: General Electric Company, Schenectady, N.Y.

[21] Appl. No.: 461,348

[22] Filed: Jan. 27, 1983

[51] Int. Cl.[3] ..... H01J 7/44; H01J 13/46; H01J 19/78; H01J 29/96

[52] U.S. Cl. ..... 315/73; 313/51; 313/623; 315/74

[58] Field of Search ..... 315/73, 74, 75; 313/49, 313/51, 623; 316/1, 19, 22, 26, 17; 29/25.11

[56] References Cited

U.S. PATENT DOCUMENTS

| | | | |
|---|---|---|---|
| 2,462,335 | 2/1949 | Reinhardt | 315/75 X |
| 4,097,779 | 6/1978 | Latassa | 315/73 |
| 4,114,968 | 9/1978 | Latassa | 316/1 |
| 4,132,922 | 1/1979 | Newton et al. | 315/73 |
| 4,156,831 | 5/1979 | Cassidy et al. | 315/73 |

FOREIGN PATENT DOCUMENTS

| | | | |
|---|---|---|---|
| 44-110702 | 11/1969 | Japan | 315/73 |

*Primary Examiner*—Saxfield Chatmon
*Attorney, Agent, or Firm*—Philip L. Schlamp

[57] ABSTRACT

A rapid start fluorescent lamp comprising a pair of cathode mounts each having a pair of lead-in wires for cathode heating current, and a thermal switch to turn off the heating current after sufficient cathode heating for the lamp to operate. A third lead-in wire in each mount bypasses the thermal switch and is used for heating the cathodes to activate them during manufacturing.

7 Claims, 3 Drawing Figures

FLUORESCENT LAMP WITH CATHODE HEAT SWITCHES

BACKGROUND OF THE INVENTION

The invention is in the field of fluorescent lamps of the rapid start type, the lamps being provided with thermal switches, responsive to cathode heat, for turning off the cathode heating current after starting and during lamp operation.

Rapid start fluorescent lamps are provided with cathode heating current, for heating the cathodes to electron-emitting temperature so that the lamps start quickly without damaging the electron-emitting material of the cathodes. The cathode heating consumes about one and one-half to two watts of electrical power per cathode. While the lamps are operating, "hot spots" form on the cathodes and can provide adequate electron emission without the need for continuing to supply heating current through the cathodes. Thus, turning off the cathode heating current when the lamps are operating can save about three or four watts of electrical energy per lamp, resulting in considerable energy and money savings in lighting systems, such as in large buildings, having hundreds or thousands of lamps.

U.S. Pat. Nos. 4,097,779 and 4,114,968 to Latassa disclose rapid start fluorescent lamps provided with a thermal cutout switch near each cathode, and in electrical series with the associated cathode, for turning off the cathode current after the lamps start and while they are operating. More specifically, these patents disclose U-shaped bimetal switches sealed in glass envelopes and mounted near each cathode. After each cathode is heated sufficiently by the heating current (in a second or so), heat from the cathode causes the nearby bimetal switch member to bend and open the current circuit to the cathode.

The manufacture of fluorescent lamps involves coating the tungsten cathode coils with an electron emission coating, such as a mixture of alkaline earth oxides in the form of carbonates. After the lamps are assembled, with a cathode mount in each end region of a glass tube, the cathodes are "activated" by passing current through them to heat them, for a sufficient time such as 20 seconds, to convert the carbonates into oxides. However, with the aforesaid cathode current cutout switches in the lamps, these switches when suitably designed for reliably functioning as described above, will turn off the activation cathode heating current prior to complete activation of the cathodes, thus preventing proper activation. The aforesaid U.S. Pat. No. 4,114,968 solves this problem by connecting fuse wires across the thermal switches, for shorting the switches and permitting proper activation of the cathodes. The fuses are then "blown", i.e., severed, by applying an electrical pulse through each of the series-connected fuses and cathodes. The fuses can be a difficult and critical item since they must be able to carry the cathode activation current and also be capable of being "blown" by a current pulse of insufficient strength to damage the cathode. Also, the timing is critical, since the fuse-blowing pulse must be applied while the thermal switch is in open condition so it will not short-circuit the pulse away from the fuse.

SUMMARY OF THE INVENTION

Objects of the invention are to provide a fluorescent lamp having cathode-heat current cutout thermal switch means, in combination with improved means providing for activation of the cathodes during manufacturing of the lamp.

The invention comprises, briefly and in a preferred embodiment, a rapid start fluorescent lamp provided with a pair of cathode mounts each having a pair of lead-in wires for cathode heating current, and a thermal switch to turn off the heating current after sufficient initial cathode heating and during operation of the lamps. A third lead-in wire is provided in each mount and bypasses the thermal switch, and is used for heating the cathodes to activate them during manufacturing. After activating the cathodes, the third lead-in wire is not used, and the pairs of lead-in wires are connected to terminals of the lamp's end cap bases.

DESCRIPTION OF THE PREFERRED EMBODIMENT

Figure 1:
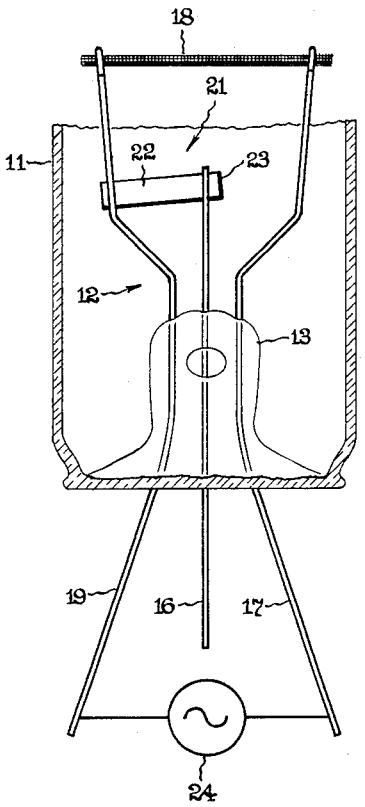
FIG. 1 is a side view of one of the end regions of a fluorescent lamp, in accordance with a preferred embodiment of the invention, showing the step of cathode activation during lamp manufacturing.

FIG. 1 shows one of the two end regions of a fluorescent lamp prior to basing, and comprising a bulb 11 preferably of glass and coated internally with phosphor material and containing a gas fill, in well-known manner. A cathode mount 12 comprises a glass stem 13 sealed to the end of bulb 11. A pair of lead-in wires 16, 17 are sealed in and pass through the stem 13, and are used to supply cathode heating current to cathode 18 during lamp operation. According to the invention, a third lead-in wire 19 is sealed in and passes through the stem 13 and is used for supplying activation current to the cathode 18 during lamp manufacture. The cathode 18 is attached to and connected across the inner ends of the lead-in wires 17 and 19. A thermal switch 21 is positioned near the cathode 18, and in a preferred embodiment comprises a thermally deflectable bimetal strip 22, which may be substantially straight as shown, or U-shaped or other suitable configuration, an end region of this strip being attached to the lead-in wire 19 by suitable means such as welding, and the other end region (contact end) 23 being in contact against the lead-in wire 16, as shown, at room or other ambient temperature. Alternatively, end 23 of strip 22 can be attached to wire 16 and the other end can be the contact against wire 19.

Figure 3:
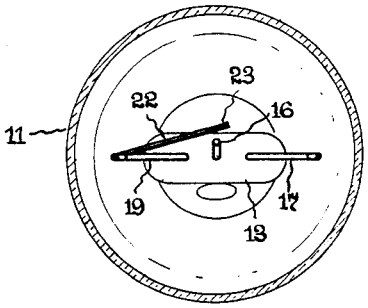
FIG. 3 is a cross-sectional view taken on the line 3—3 of FIG. 2, when the lamp is operating.

For the cathode activation during manufacturing, which has been generally described above, a voltage source 24 is connected across the lead-in wires and supplies suitable current through the cathode 18, via the wires 17 and 19, for a suitable time such as about 20 seconds, to convert and activate the emission mix material on the cathodes, as described above. Both cathodes of a lamp are similarly activated, during which the bimetal switch strip 22 will bend, due to being heated by the heat of the cathodes 18, and move out of contact with the wire 16 as shown in FIG. 3; however, this has no effect on the cathode activation process.

Figure 2:
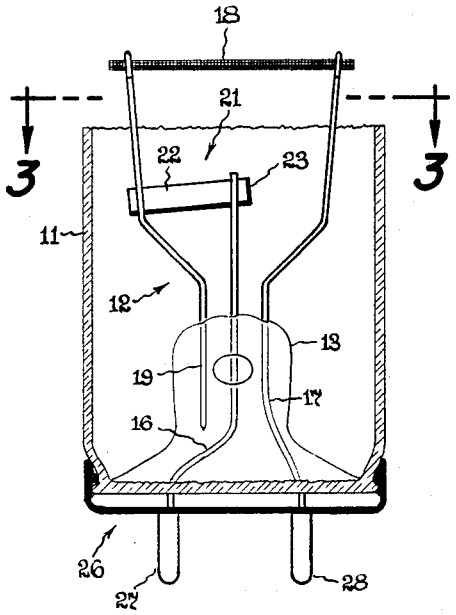
FIG. 2 is a side view of one of the end regions of a completed lamp.

After each lamp cathode 18 has been activated as described above, the lead-in wires 19 are not further used, and their end portions may be clipped off and removed as in FIG. 2, or they may be bent out of the way. Alternatively, the lead-in wires 19 may be short initially as shown in FIG. 2. An end-cap base 26 is then attached to each end of the bulb 11, and may comprise a pair of terminal pins 27, 28 to which the lead-in wires 16 and 17 are respectively connected, as shown in FIG. 2, by soldering, welding, or other suitable means.

When the lamps of the invention are installed in lighting fixtures having circuits of the rapid-start type, such as disclosed in U.S. Pat. No. 4,185,233 to Riesland et al, and the circuit is turned on, heating current is applied to the pairs of terminals 27, 28, to heat the cathodes 18 to suitable electron-emitting temperature, whereupon a discharge occurs in the gas of the lamps and the lamps produce light in well-known manner. As stated above, each cathode consumes a few watts of heating power. To conserve energy, when the lamps are operating, each thermal switch 21 is so constructed, and positioned with respect to the associated cathode, so that the switches open, due to being heated by the associated cathode, soon after the cathodes reach operating temperature (usually about one second). Thereafter, the hot spots that form on the cathodes due to electron emission are at an adequate temperature to maintain suitable lamp operation and to maintain the switches 21 in open positions thereby removing the cathode heating currents and conserving a few watts of electrical power.

The invention has been found to achieve its objective of conserving electrical energy and providing for proper and complete activation of the lamp cathodes during manufacture, with a reliable and economical construction.

While preferred embodiments and modifications of the invention have been shown and described, various other embodiments and modifications thereof will become apparent to persons skilled in the art and will fall within the scope of the invention as defined in the following claims.

What we claim as new and desire to secure by Letters Patent of the United States:

1. A rapid start type of fluorescent lamp comprising: an elongated bulb; a pair of lamp stems sealing the respective ends of said bulb; each lamp stem comprising a cathode mount having a cathode, first and second lead-in wires extending through said cathode mount for providing operating heating current to the cathode, and a third lead-in wire extending through said cathode mount and connected to said cathode; one of said first and second lead-in wires having a thermally operated switch associated therewith and disposed in operating relationship with said third lead-in wire for turning off said cathode heating current in response to heat from the cathode; and said third lead-in wire comprising a current path bypassing said switch.

2. A lamp as claimed in claim 1, in which said switch comprises a heat-responsive bimetal element.

3. A lamp as claimed in claim 2, in which said bimetal element comprises an elongated bimetal strip attached to one of said first and third lead-in wires and in contact against the other of said first and third lead-in wires at ambient temperature.

4. A lamp as claimed in claim 3, in which said bimetal strip is attached to said third lead-in wire and is in contact against said first lead-in wire at ambient temperature.

5. A method of activating a fluorescent lamp cathode in a lamp having a pair of first and second lead-in wires for providing operating current to the ends of and through the cathode, and a thermally operated cathode current cutout switch interposed in series with said first lead-in wire, wherein the improvement comprises the steps of providing a third lead-in wire connected to the end of the cathode to which said first lead-in wire provides current, and applying a source of cathode activation current to said second and third lead-in wires.

6. A method in accordance with claim 5, including the additional steps of providing a pair of lamp connection terminals and connecting said terminals respectively to said first and second lead-in wires.

7. The lamp of claim 1, further comprising a pair of end-cap bases each disposed upon a respective end of said bulb; each of said bases having a pair of terminal pins attached thereto and connected respectively to said first and second lead-in wires.

* * * * *